US009997868B1

(12) United States Patent
Smith, Jr. et al.

(10) Patent No.: US 9,997,868 B1
(45) Date of Patent: Jun. 12, 2018

(54) ELECTRICAL CONNECTOR WITH IMPROVED IMPEDANCE CHARACTERISTICS

(71) Applicant: TE Connectivity Corporation, Berwyn, PA (US)

(72) Inventors: Graham Harry Smith, Jr., Mechanicsburg, PA (US); Scott Eric Walton, Mount Joy, PA (US); Albert Tsang, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days. days.

(21) Appl. No.: 15/657,997

(22) Filed: Jul. 24, 2017

(51) Int. Cl.

| | |
|---|---|
| ***H01R 12/00*** | (2006.01) |
| ***H01R 13/6461*** | (2011.01) |
| ***H01R 12/72*** | (2011.01) |
| ***H01R 12/73*** | (2011.01) |
| ***H01R 12/70*** | (2011.01) |

(52) U.S. Cl.
CPC ..... *H01R 13/6461* (2013.01); *H01R 12/7005* (2013.01); *H01R 12/721* (2013.01); *H01R 12/732* (2013.01)

(58) Field of Classification Search
CPC ..... H01R 13/6461; H01R 13/514; H01R 13/6585; H01R 13/502; H01R 13/6873; H01R 12/7005; H01R 12/52; H01R 12/721; H01R 12/732
See application file for complete search history.

(56) References Cited

U.S. PATENT DOCUMENTS

| | | | |
|---|---|---|---|
| 3,223,960 | A | 12/1965 | Ruehlemann |
| 5,093,640 | A | 3/1992 | Bischof |
| 6,171,115 | B1 | 1/2001 | Mickievicz et al. |
| 6,267,604 | B1 | 7/2001 | Mickievicz et al. |
| 6,379,188 | B1 | 4/2002 | Cohen et al. |
| 6,655,966 | B2 | 12/2003 | Rothermel et al. |
| 6,663,442 | B1 | 12/2003 | Helster et al. |
| 6,811,440 | B1 | 11/2004 | Rothermel et al. |

(Continued)

FOREIGN PATENT DOCUMENTS

| | | | |
|---|---|---|---|
| DE | 10 2007 002 202 | A1 | 8/2007 |
| EP | 0 806 814 | A2 | 11/1997 |

(Continued)

*Primary Examiner* — Jean F Duverne

(57) ABSTRACT

A shroud that forms part of an electrical connector for securing a plurality of circuit wafers within the electrical connector includes a top wall, a bottom wall, and a plurality of vertical members extending between the top and bottom walls that define a plurality of slots for receiving the plurality of circuit wafers. Each vertical member includes a first side that faces a second side of an adjacent vertical member. The first side defines top, middle, and bottom surface regions that are spaced apart from the second side of the adjacent vertical member by a first distance, and first and second recessed surface regions between the top, middle, and bottom surface regions that are spaced apart from the second side of the adjacent vertical member by a second distance that is greater than the first distance. The first and second recessed surface regions are positioned so as to prevent direct contact between the vertical members and one or more high-frequency traces disposed on the plurality of circuit wafers.

20 Claims, 4 Drawing Sheets

(56) References Cited

U.S. PATENT DOCUMENTS

| | | | | |
|---|---|---|---|---|
| 6,824,391 | B2 | 11/2004 | Mickievicz et al. | |
| 6,875,031 | B1 * | 4/2005 | Korsunsky | H01R 23/6873 439/79 |
| 7,044,794 | B2 | 5/2006 | Consoli et al. | |
| 7,175,445 | B2 | 2/2007 | Consoli et al. | |
| 7,326,092 | B2 | 2/2008 | Fedder et al. | |
| 8,550,861 | B2 | 10/2013 | Cohen et al. | |
| 8,727,791 | B2 | 5/2014 | Gulla | |
| 9,017,114 | B2 | 4/2015 | Cohen et al. | |
| 9,033,750 | B2 | 5/2015 | Miller et al. | |
| 9,173,292 | B1 | 10/2015 | Sokol et al. | |
| 9,190,745 | B2 | 11/2015 | Gulla | |
| 9,450,344 | B2 * | 9/2016 | Cartier, Jr. | H01R 13/6585 |
| 9,520,689 | B2 * | 12/2016 | Cartier, Jr. | H01R 43/16 |
| 2004/0171305 | A1 * | 9/2004 | McGowan | H01R 13/502 439/607.06 |
| 2004/0180562 | A1 | 9/2004 | Raistrick et al. | |
| 2004/0235352 | A1 * | 11/2004 | Takemasa | H01R 12/52 439/607.07 |
| 2005/0048838 | A1 * | 3/2005 | Korsunsky | H01R 13/6585 439/607.11 |
| 2005/0048842 | A1 * | 3/2005 | Benham | H01R 13/514 439/65 |
| 2006/0014433 | A1 | 1/2006 | Consoli et al. | |
| 2006/0068640 | A1 * | 3/2006 | Gailus | H01R 13/719 439/607.08 |
| 2006/0172566 | A1 | 8/2006 | Nakajima et al. | |
| 2007/0004282 | A1 * | 1/2007 | Cohen | H01R 13/514 439/607.02 |
| 2007/0021004 | A1 * | 1/2007 | Laurx | H01R 13/514 439/607.05 |
| 2007/0042639 | A1 * | 2/2007 | Manter | H01R 13/514 439/552 |
| 2008/0246555 | A1 * | 10/2008 | Kirk | H01R 13/514 333/125 |
| 2009/0233459 | A1 | 9/2009 | Shiramizu et al. | |
| 2010/0096165 | A1 | 4/2010 | Lo et al. | |
| 2014/0308852 | A1 | 10/2014 | Gulla | |
| 2014/0329414 | A1 | 11/2014 | Cohen et al. | |
| 2015/0049444 | A1 | 2/2015 | Venk et al. | |
| 2015/0129284 | A1 | 5/2015 | Aparimarn et al. | |
| 2015/0359082 | A1 | 12/2015 | Nishimura et al. | |

FOREIGN PATENT DOCUMENTS

| | | | |
|---|---|---|---|
| EP | 1 545 170 | A1 | 12/2004 |
| EP | 1 940 207 | A2 | 7/2008 |
| EP | 2 091 307 | A1 | 8/2009 |
| EP | 2 775 732 | A1 | 10/2014 |
| NO | 2015 029942 | A1 | 3/2015 |

* cited by examiner

ELECTRICAL CONNECTOR WITH IMPROVED IMPEDANCE CHARACTERISTICS

BACKGROUND

I. Field

The present invention relates generally to electrical connectors carrying high-frequency signals. More specifically, the present invention relates to an electrical connector with an improved shroud configuration that results in improved impedance characteristics.

II. Description of Related Art

Some electrical systems incorporate a number of electrical modules that are interconnected with one another via a backplane circuit board. Connectors on the modules facilitate insertion of the modules into complementary connectors on the backplane.

Each connector may be configured to couple one or more signals between the electrical module and the backplane. Signals transferred via the connector may be relatively high-frequency signals. Special care must be taken in the construction of the connector to minimize degradation of any signals communicated over the connector.

SUMMARY

In one aspect, a shroud that forms part of an electrical connector for securing a plurality of circuit wafers within the electrical connector includes a top wall, a bottom wall, and a plurality of vertical members extending between the top and bottom walls that define a plurality of slots for receiving the plurality of circuit wafers. Each vertical member includes a first side that faces a second side of an adjacent vertical member. The first side defines top, middle, and bottom surface regions that are spaced apart from the second side of the adjacent vertical member by a first distance, and first and second recessed surface regions between the top, middle, and bottom surface regions that are spaced apart from the second side of the adjacent vertical member by a second distance that is greater than the first distance. The first and second recessed surface regions are positioned so as to prevent direct contact between the vertical members and one or more high-frequency traces disposed on the plurality of circuit wafers.

In a second aspect, an electrical connector includes a bottom housing, a plurality of circuit wafers disposed within the bottom housing, where each circuit wafer includes one or more high-frequency traces for communicating high-frequency signals. The electrical connector also includes a shroud that forms atop of the electrical connector that is configured to engage the bottom housing to secure the plurality of circuit wafers between the bottom housing and the shroud. The shroud includes a top wall, a bottom wall, and a plurality of vertical members that extend between the top and bottom walls that define a plurality of slots for maintaining spacing between the plurality of circuit wafers. Each vertical member includes a first side that faces a second side of an adjacent vertical member. The first side defines top, middle, and bottom surface regions that are spaced apart from the second side of the adjacent vertical member by a first distance, and first and second recessed surface regions between the top, middle, and bottom surface regions that are spaced apart from the second side of the adjacent vertical member by a second distance that is greater than the first distance. The first and second recessed surface regions are positioned so as to prevent direct contact between the vertical members and the one or more high-frequency traces disposed on the plurality of circuit wafers to thereby improve impedance characteristics of the electrical connector.

In a third aspect, an electrical product includes an electrical connector. The electrical connector includes a bottom housing, a plurality of circuit wafers disposed within the bottom housing, where each circuit wafer includes one or more high-frequency traces for communicating high-frequency signals. The electrical connector also includes a shroud that forms atop of the electrical connector that is configured to engage the bottom housing to secure the plurality of circuit wafers between the bottom housing and the shroud. The shroud includes a top wall, a bottom wall, and a plurality of vertical members that extend between the top and bottom walls that define a plurality of slots for maintaining spacing between the plurality of circuit wafers. Each vertical member includes a first side that faces a second side of an adjacent vertical member. The first side defines top, middle, and bottom surface regions that are spaced apart from the second side of the adjacent vertical member by a first distance, and first and second recessed surface regions between the top, middle, and bottom surface regions that are spaced apart from the second side of the adjacent vertical member by a second distance that is greater than the first distance. The first and second recessed surface regions are positioned so as to prevent direct contact between the vertical members and the one or more high-frequency traces disposed on the a plurality of circuit wafers to thereby improve impedance characteristics of the electrical connector.

DETAILED DESCRIPTION

Figure 1:
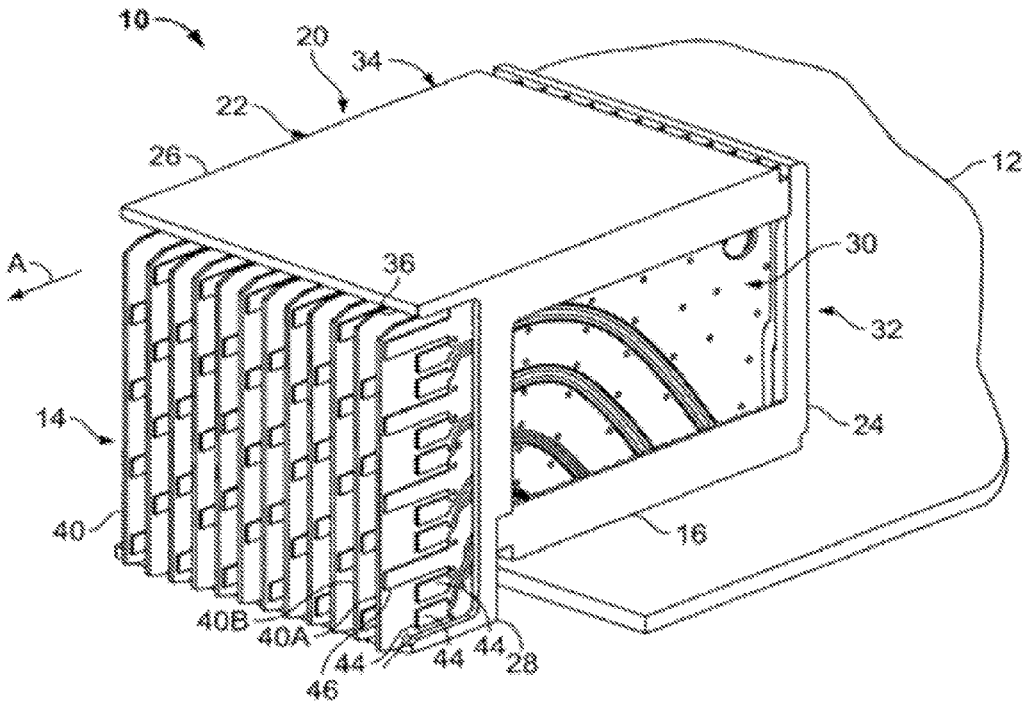
FIG. 1 illustrates a perspective view of an improved electrical connector formed in accordance with an exemplary embodiment that houses a plurality of the exemplary circuit wafers.

FIG. 1 illustrates a perspective view of an electrical connector 10 formed in accordance with an exemplary embodiment. The electrical connector 10 may be one of many disposed on a specialized circuit module to facilitate electrically coupling signals on the circuit module with other circuit modules via a backplane circuit board of a product such RF test equipment and the like.

The connector 10 may correspond to a receptacle connector configured to be mounted on a circuit board 12 which in an exemplary embodiment is a daughter board. The connector 10 has a mating face 14 and a mounting face 16 that includes an interface for mounting the connector 10 to the circuit board 12.

In an exemplary embodiment, the mounting face 16 is substantially perpendicular to the mating face 14 such that the receptacle connector 10 interconnects electrical components that are substantially at a right angle to each other. The mating face 14 of the connector 10 defines a backplane connector interface. In one embodiment, the connector 10 may be used to interconnect a daughter board to a backplane circuit board. In other embodiments, the connector 10 may be configured to interconnect electrical components that are at other than a right angle to each other.

While the invention will be described in terms of a connector carrying differential signals, it is to be understood that the following description is for illustrative purposes only and is but one potential application of the inventive concepts herein. It is appreciated that the benefits and advantages of the invention may accrue equally to other types of signal connectors and wafer combinations.

The connector 10 includes a dielectric housing 20 that has an upper housing portion or shroud 22 and a lower housing portion 24. The shroud 22 includes top and bottom walls 26 and 28, respectively, that are proximate the mating face 14 of the connector 10. The top wall 26 and bottom wall 28 extend forwardly from upper housing 22 in the direction of arrow A, which is also the mating direction of the connector 10.

The shroud 22 may include end openings 30 at a first end 32 and a second end 34. The shroud 22 and lower housing portion 24 are coupled together forming an open framework for holding a plurality of circuit wafers 40 that are received into the housing 20 with a card edge connection.

The circuit wafers 40 include signal contact pads 44, ground contact pads 46, and high-frequency traces for routing signals communicated via the contact pads 44.

The connector 10 is modular in construction; and in the embodiment shown in FIG. 1, includes twelve circuit wafers 40. It is to be understood that in alternative embodiments, a greater or fewer number of the circuit wafers 40 may be used.

Figure 2A:
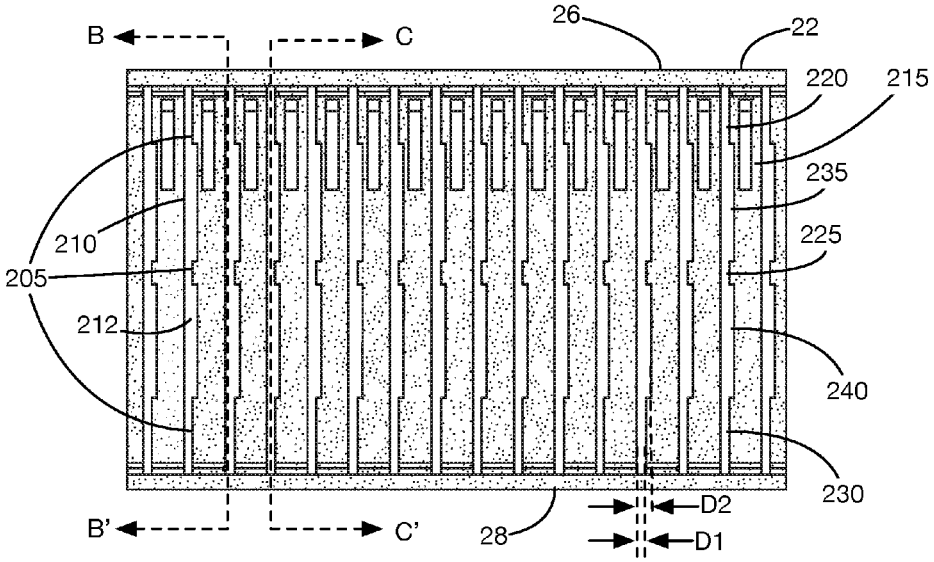
FIG. 2A illustrates a front view of a shroud of the improved electrical connector when viewed in direction A of FIG. 1.
Figure 2B:
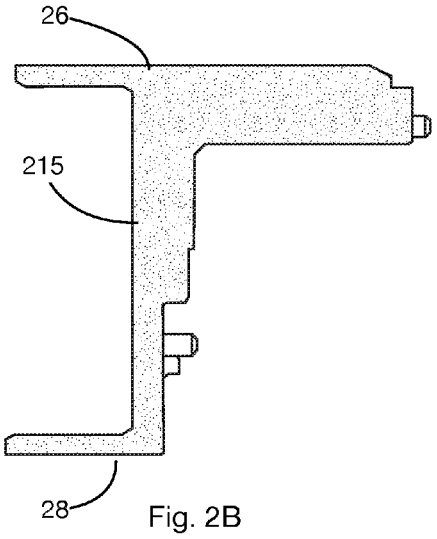
FIG. 2B illustrates a cross-section of the shroud taken along section B-B' of FIG. 2A.
Figure 2C:
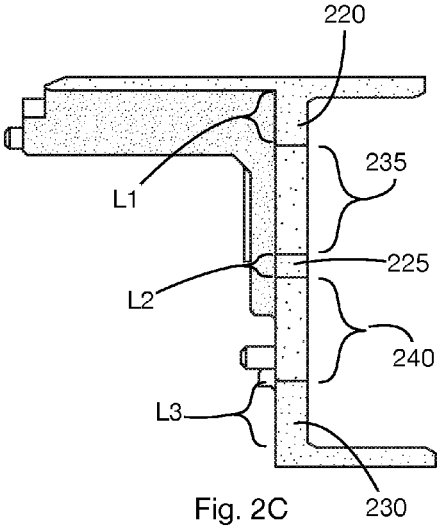
FIG. 2C illustrates a cross-section of the shroud taken along section C-C' of FIG. 2A.

FIG. 2A illustrates a front view of the shroud 22 when viewed in direction A of FIG. 1. FIG. 2B illustrates a cross-section view taken along section B-B' of FIG. 2A. FIG. 2C illustrates a cross-section view taken along section C-C' of FIG. 2A.

As noted above, the shroud 22 corresponds to the top of the electrical connector 10. The shroud 22 is configured to cooperate with the lower housing portion 24 of the electrical connector 10 to secure the circuit wafers 40 between the lower housing portion 24 and the shroud 22.

Referring to FIGS. 2A-2C, the shroud 22 includes a top wall 26, a bottom wall 28, and a plurality of vertical members 215 that extend between the top and bottom walls 26 and 28. The vertical members 215 define a plurality of slots 212 for receiving the circuit wafers 40 and for maintaining spacing between the circuit wafers 40.

Each vertical member 215 includes a first side 205 that faces a second side 210 of an adjacent vertical member. The first side 205 defines top, middle, and bottom surface regions 220, 225, and 230 that are spaced apart from the second side 210 of the adjacent vertical member by a first distance, D1. The first side 205 may also define first and second recessed surface regions 235 and 240 between the top, middle, and bottom surface regions 220, 225, and 230. The second side 210 of the vertical member 215 may be generally flat or may have features similar to those found on the first side 205.

The first and second recessed surface regions 235 and 240 are spaced apart from the second side 210 of the adjacent vertical member 215 by a second distance, D2, that is greater than the first distance, D1. Distance D1 may generally correspond to the thickness of a circuit wafer 40 to facilitate a snug fit between the shroud 22 and the circuit wafer 40. For example, for a circuit wafer 40 with a thickness of just under about 0.45 mm, the first distance, D1, may be about 0.45 mm to provide a snug fit. The second distance, D2, is selected to ensure that no portion of the vertical member 215 in the first and second recessed surface regions 235 and 240 contacts the circuit wafers 40. For example, the second distance, D2, may be about 0.60 mm. This ensures that the first and second recessed surface regions 235 and 240 do not make contact with the circuit wafer 40.

Figure 3A:
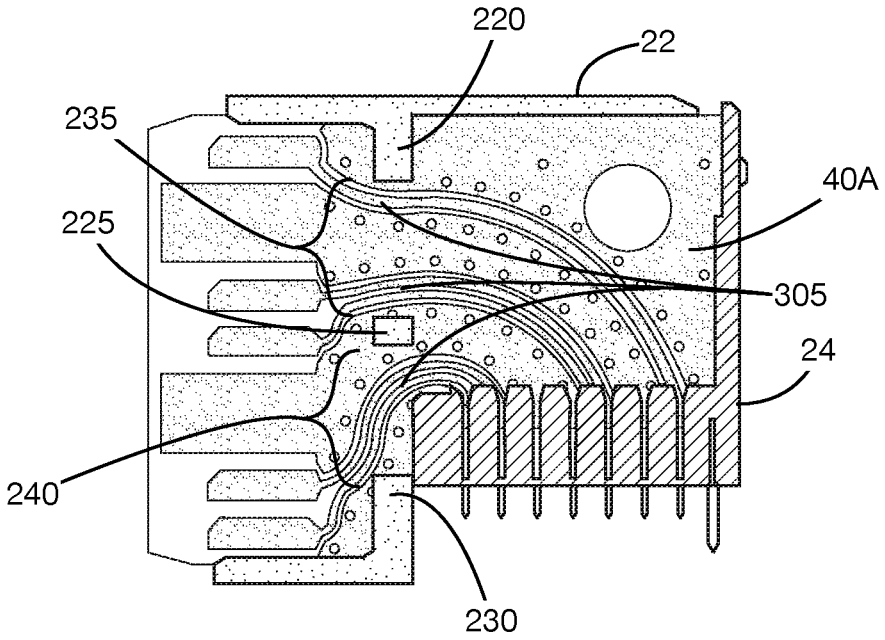
FIGS. 3A and 3B illustrate different circuit wafers positioned within the shroud of the improved electrical connector.
Figure 3B:
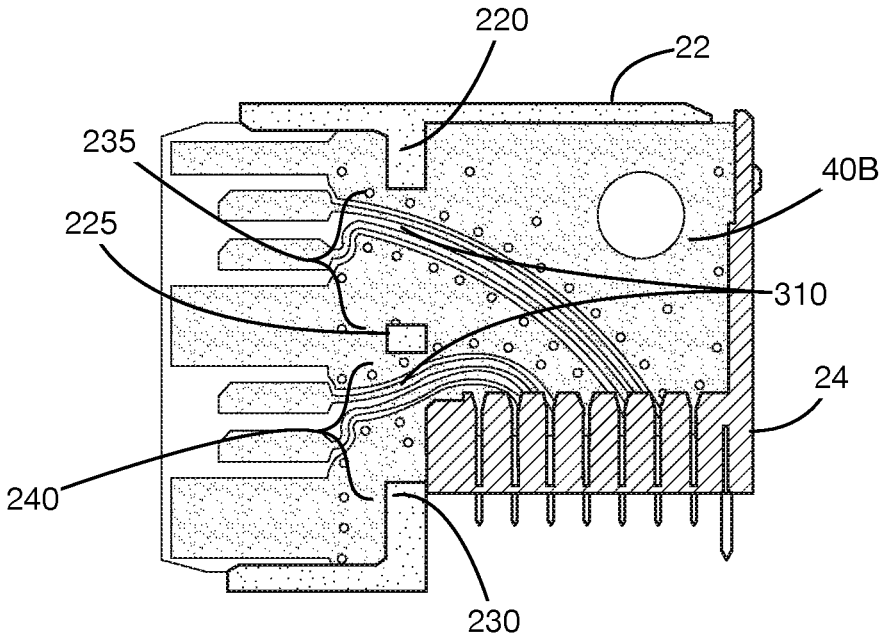

Referring to FIGS. 3A and 3B, the size and position of the top, middle, and bottom surface regions 220, 225 and 230 may be selected to prevent the first side 205 of the vertical member 215 from making direct contact with critical regions of the circuit wafer 40, such as regions where high-frequency traces 305 and 310 may be arranged, as illustrated. Stated differently, the arrangement of the top, middle, and bottom surface regions 220, 225, and 230 are selected so that the first and second recessed surface regions 235 and 240 of the vertical members 215 are positioned over the critical regions of the circuit wafer 40. Preventing contact between the vertical members 215 and the circuit wafers 40 in the critical regions may help to improve the impedance characteristics of the electrical connector.

In one exemplary implementation, the top surface region 220 may extend down from the top wall 26 by a distance, L1, of about 3.12 mm. The bottom surface region 230 may extend upward from the bottom wall 28 by a distance, L3, of about 2.22 mm. The middle surface region 225 may be vertically centered within the vertical member 215 and have a height, L2, of about 4.18 mm. This arrangement may provide for first and second recessed surface regions 235 and 240 having a length of about between about 4.90 mm-5.15 mm.

In some implementations, circuit wafers having different high-frequency trace arrangements may be utilized. For example, FIG. 3A illustrates a first type of circuit wafer 40A with five high-frequency traces 305. FIG. 3B illustrates a second type of circuit wafer 40B with four high-frequency traces 310. In this case, the arrangement of the size and position of the top, middle, and bottom surface regions 220, 225 and 230 may be selected to prevent the first side 205 of the vertical member 215 from making direct contact with critical regions of either type of circuit wafer 40A and 40B.

Figure 4A:
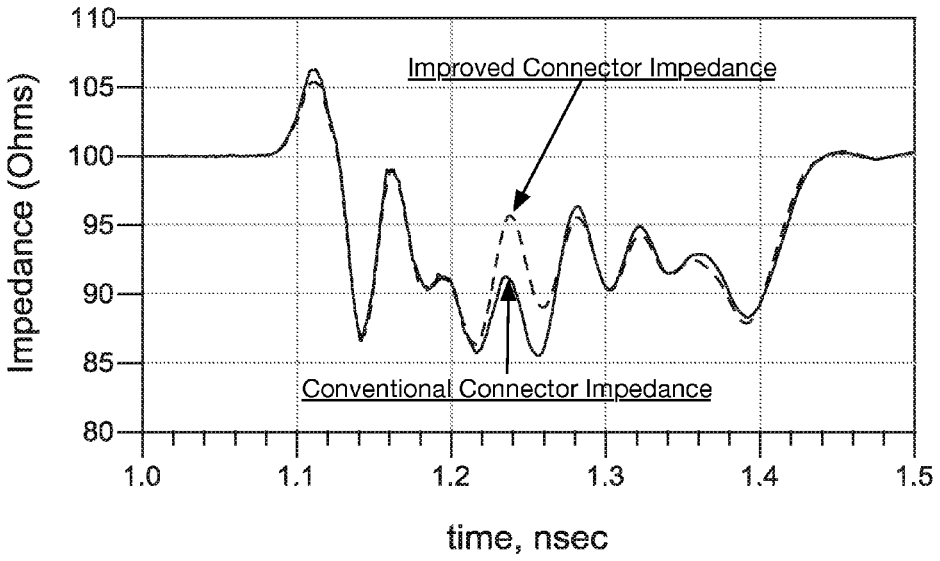
FIGS. 4A and 4B illustrate impedance waveforms associated with the improved electrical connector and a conventional electrical connector.
Figure 4B:
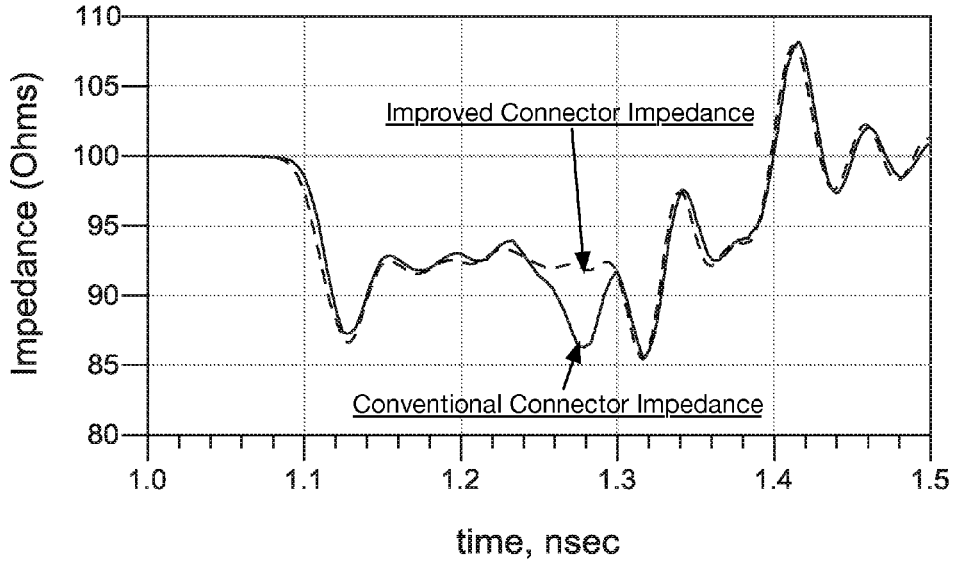

FIGS. 4A and 4B illustrate impedance waveforms simulated using a 16 ps 20/80 rise time. The wave forms help illustrate the improvements in impedance that may be realized with the arrangements described above when compared to conventional connectors that utilize shrouds that do not have the features described above. In FIG. 4A, the TDR pulse is injected into the backplane-side of both a conventional and improved connector; and in FIG. 4B, the TDR pulse is injected into the daughter card-side of both the conventional and improved connector. Both waveforms indicate about a 5 ohm improvement in the impedance, where the ideal impedance is 100 ohms.

While the shroud and electrical connector have been described with reference to certain embodiments and dimensions, it will be understood by those skilled in the art that various changes may be made and equivalents may be substituted without departing from the spirit and scope of the claims of the application. For example, one reason for providing the middle surface region 225 is to provided additional support for the circuit wafer 40. However, in circumstances where the extra support is not required, the middle surface region 225 may be remove to provide a continuous recessed region between the top and bottom surface regions 220 and 230. Other modifications may be made to adapt a particular situation or material to the teachings disclosed above without departing from the scope of the claims. Therefore, the claims should not be construed as being limited to any one of the particular embodiments disclosed, but to any embodiments that fall within the scope of the claims.

We claim:

1. A shroud that forms part of an electrical connector for securing a plurality of circuit wafers within the electrical connector, the shroud comprising:

a top wall;

a bottom wall;

a plurality of vertical members extending between the top and bottom walls that define a plurality of slots for receiving the plurality of circuit wafers, each vertical member including a first side that faces a second side of an adjacent vertical member;

wherein the first side defines top, middle, and bottom surface regions that are spaced apart from the second side of the adjacent vertical member by a first distance, and first and second recessed surface regions between the top, middle, and bottom surface regions that are spaced apart from the second side of the adjacent vertical member by a second distance that is greater than the first distance, wherein the first and second recessed surface regions are positioned so as to prevent direct contact between the vertical members and one or more high-frequency traces disposed on the plurality of circuit wafers.

2. The shroud according to claim 1, wherein the top surface region extends from the top wall to a top section of the first recessed surface region and the bottom surface region extends from the bottom wall to a bottom section of the second recessed surface region.

3. The shroud according to claim 1, wherein the middle surface region is centered between the top wall and the bottom wall.

4. The shroud according to claim 1, wherein a height of the first and second recessed surface regions are about 5.0 mm.

5. The shroud according to claim 1, wherein the first distance is about 0.45 mm and the second distance is about 0.60 mm.

6. The shroud according to claim 1, wherein a surface of the second side is substantially flat.

7. An electrical connector comprising:

a bottom housing;

a plurality of circuit wafers disposed within the bottom housing, each circuit wafer includes one or more high-frequency traces for communicating high-frequency signals; and a shroud that forms a top of the electrical connector that is configured to engage the bottom housing to secure the plurality of circuit wafers between the bottom housing and the shroud, the shroud comprising:

a top wall;

a bottom wall;

a plurality of vertical members extending between the top and bottom walls that define a plurality of slots for maintaining spacing between the plurality of circuit wafers, each vertical member including a first side that faces a second side of an adjacent vertical member;

wherein the first side defines top, middle, and bottom surface regions that are spaced apart from the second side of the adjacent vertical member by a first distance, and first and second recessed surface regions between the top, middle, and bottom surface regions that are spaced apart from the second side of the adjacent vertical member by a second distance that is greater than the first distance, wherein the first and second recessed surface regions are positioned so as to prevent direct contact between the vertical members and the one or more high-frequency traces disposed on the a plurality of circuit wafers to thereby improve impedance characteristics of the electrical connector.

8. The electrical connector according to claim 7, wherein the top surface region extends from the top wall to a top section of the first recessed surface region and the bottom surface region extends from the bottom wall to a bottom section of the second recessed surface region.

9. The electrical connector according to claim 7, wherein the middle surface region is centered between the top wall and the bottom wall.

10. The electrical connector according to claim 7, wherein a height of the first and second recessed surface regions is about 5.0 mm.

11. The electrical connector according to claim 7, wherein the first distance is about 0.45 mm and the second distance is about 0.60 mm.

12. The electrical connector according to claim 7, wherein a surface of the second side is substantially flat.

13. The electrical connector according to claim 7, wherein the plurality of circuit wafers includes a first group of circuit wafers and a second group of circuit wafers, wherein an arrangement of the one or more high-frequency traces on the first group of circuit wafers is different from an arrangement of the one or more high frequency traces on the second group of circuit wafers; and wherein the first and second recessed surface regions of the vertical members are arranged in a same relative position for each vertical member and arranged so as to prevent direct contact between the vertical members and the one or more high-frequency traces disposed on both the first and second group of circuit wafers.

14. An electrical product that includes an electrical connector, the electrical connector comprises:

a bottom housing;

a plurality of circuit wafers disposed within the bottom housing, each circuit wafer includes one or more high-frequency traces for communicating high-frequency signals; and a shroud that forms a top of the electrical connector that is configured to engage the bottom housing to secure the plurality of circuit wafers between the bottom housing and the shroud, the shroud comprising:

a top wall;

a bottom wall;

a plurality of vertical members extending between the top and bottom walls that define a plurality of slots for maintaining spacing between the plurality of circuit wafers, each vertical member including a first side that faces a second side of an adjacent vertical member;

wherein the first side defines top, middle, and bottom surface regions that are spaced apart from the second side of the adjacent vertical member by a first distance, and first and second recessed surface regions between the top, middle, and bottom surface regions that are spaced apart from the second side of the adjacent vertical member by a second distance that is greater than the first distance, wherein the first and second recessed surface regions are positioned so as to prevent direct contact between the vertical members and the one or more high-frequency traces disposed on the a plurality of circuit wafers to thereby improve impedance characteristics of the electrical connector.

15. The electrical product according to claim 14, wherein the top surface region extends from the top wall to a top section of the first recessed surface region and the bottom surface region extends from the bottom wall to a bottom section of the second recessed surface region.

16. The electrical product according to claim 14, wherein the middle surface region is centered between the top wall and the bottom wall.

17. The electrical product according to claim 14, wherein a height of the first and second recessed surface regions is about 5.0 mm.

18. The electrical product according to claim 14, wherein the first distance is about 0.45 mm and the second distance is about 0.60 mm.

19. The electrical product according to claim 14, wherein a surface of the second side is substantially flat.

20. The electrical product according to claim 14, wherein the plurality of circuit wafers includes a first group of circuit wafers and a second group of circuit wafers, wherein an arrangement of the one or more high-frequency traces on the first group of circuit wafers is different from an arrangement of the one or more high frequency traces on the second group of circuit wafers; and wherein the first and second recessed surface regions of the vertical members are arranged in a same relative position for each vertical member and arranged so as to prevent direct contact between the vertical members and the one or more high-frequency traces disposed on both the first and second group of circuit wafers.

* * * * *